United States Patent [19]

Mazurek

[11] Patent Number: 4,873,899

[45] Date of Patent: Oct. 17, 1989

[54] ADJUSTABLE RATCHET WRENCH FOR KEYED SHAFTS

[76] Inventor: Tadeusz L. Mazurek, 2241 Bernard, Hamtramck, Mich. 48212

[21] Appl. No.: 134,882

[22] Filed: Dec. 18, 1987

[51] Int. Cl.[4] ..... B25B 13/46; B25B 13/16; B25B 13/58

[52] U.S. Cl. ..... 81/63; 81/176.3; 81/179; 81/124.2; 81/185

[58] Field of Search ..... 81/60–63.2, 81/176.1–176.3, 124.2, 185, DIG. 11, 180.1, 179

[56] References Cited

U.S. PATENT DOCUMENTS

| | | | |
|---|---|---|---|
| 1,347,691 | 7/1920 | Forton | 81/60 |
| 1,588,619 | 6/1926 | Roye et al. | 81/179 |
| 2,481,024 | 9/1949 | Knecht | 81/94 X |
| 3,572,184 | 3/1971 | Tolli | 81/176.3 |
| 4,111,077 | 9/1978 | Cummings et al. | 81/63 |

*Primary Examiner*—Debra Meislin
*Attorney, Agent, or Firm*—Brooks & Kushman

[57] ABSTRACT

An adjustable ratchet wrench (10) for turning a shaft (12) having a key (14). The ratchet wrench (10) includes a socket element (22) received within the head (18) of the wrench. The socket element (22) has an inner diameter (24) in which a key receiving slot (27) is formed. The socket element (22) is operatively connected to the head (18) by a ratchet mechanism (28). The inner diameter (24) of the socket element (22) is effectively modified by positioning a crescent block (38) within the inner diameter (24) of the socket element (22). The crescent block may take the form of a jaw (39) or a bushing (52). The jaw may include one or two jaws which are shifted radially by an adjustment screw (45) relative to the socket element (22). The bushing (52) includes a retention mechanism (56, 57) for securing it within the inner diameter (24) of the socket element (22).

13 Claims, 2 Drawing Sheets

ADJUSTABLE RATCHET WRENCH FOR KEYED SHAFTS

TECHNICAL FIELD

The present invention relates to ratchet wrenches for positioning a shaft having a key disposed in a keyway wherein the key is engaged by the ratchet wrench for rotating the shaft to a desired position.

BACKGROUND OF THE INVENTION

Keyed shafts are used in applications where shafts must be aligned for timing or other purposes. A common example of a keyed shaft which requires rotational positioning as part of service procedures is an automobile engine crankshaft.

General purpose wrenches are not suitable for turning crankshafts because they may scratch or deform the surface of the crankshaft or key. If an automobile engine crankshaft is scratched it may make it difficult to reattach the harmonic balancer or vibration dampener to the crankshaft.

Specialized ratchet arms are available which include a ratchet gear matched to a particular crankshaft and key combination. Such ratchet arms are reversible to rotate the shaft in either direction during assembly or repair. However, since the ratchet gear is matched to a particular size crankshaft it is of limited utility. Keyed shafts may vary widely in diameter. For instance, engine crankshafts for vehicles currently range in diameter from ¾ inches to 1 ½ inches. In automotive repair facilities which service a variety of engine types a set of dedicated ratchet arms must be maintained to cover the range of crankshaft sizes. The use of dedicated wrenches is both costly and time consuming.

DISCLOSURE OF INVENTION

An object of the present invention is to provide an adjustable wrench for rotating keyed shafts in a clockwise or counterclockwise direction.

Another object of the invention is to provide a ratchet wrench for keyed shafts which is easily adjusted to fit different size shafts.

Another object of the invention is to provide a conversion kit for a ratchet wrench for keyed shafts to permit a dedicated ratchet wrench to be used with smaller shafts.

A further object of the invention is to provide a ratchet wrench for keyed shafts which is adjustable for use with different size shafts without scratching or deforming the surface of the shaft.

These and other objects of the invention are achieved by the present invention.

The present invention relates to an adjustable ratchet wrench for turning a shaft provided with a key. The ratchet wrench includes an elongated handle having a head formed on or connected to one end of the handle. An insert element or ratchet gear is captured within the head of the wrench. The insert element has a cylindrical inner diameter which extends along an axis aligned perpendicularly to the length of the handle. The insert element defines a key receiving slot extending outwardly from its inner diameter in the same direction as the axis. A ratchet mechanism is secured to the head of the wrench and functions to selectively lock the insert element against rotation in one direction while permitting rotation in an opposite direction.

According to the invention, a crescent shaped block having a substantially arcuate inner and outer surfaces is provided within the socket element. The inner and outer surfaces of the crescent block are eccentrically arranged to form the crescent shape. Circumferentially spaced ends of the crescent shaped block define a gap in the crescent block. The crescent block is positioned within the inner diameter of the insert element preferably on the opposite side of the insert element from the key receiving slot with the gap, or circumferentially spaced ends, substantially centered relative to the key receiving slot. A fastener is provided to connect the insert element to the crescent block. The crescent block is positionable in the insert element to reduce the effective inner diameter of the insert element.

According to another aspect of the present invention the crescent block may comprise a jaw means for adjusting the effective inner diameter of the insert element. The jaw means preferably includes an arcuate face substantially corresponding in shape to the inner diameter of the insert element. The jaw means may be received in a slot extending arcuately about the axis which is formed in the inner diameter of the insert element at a location diametrically opposite the key receiving slot of the insert element. An adjustment screw is rotatably connected to the jaw means for adjusting the position of the jaw means. The adjustment screw includes a threaded shaft which is received in a threaded bore extending radially outwardly from the slot through the insert element.

In a conversion kit embodiment of the present invention, the crescent block may be formed as a bushing which is inserted inside the inner diameter of the insert element. The bushing would include a retainer such as a snap ring or ball detent for locking the bushing within the insert element. The bushing preferably includes an annular ring on one side which is abutted against one end of the insert element. One or more bushings may be provided in a range of sizes as a kit for a socket wrench having a socket for turning keyed shafts.

In another embodiment two jaw means can be provided in two slots formed in &.he socket element. The two jaws are preferably connected to the socket element by pivot pins located equidistant from the keyway on opposite sides of the keyway.

The jaw means preferably includes an arcuate extension, or reinforcement flange, which extends radially outwardly from the outer surface intermediate the width of the jaw means. If so, the socket element would include an arcuate slot for receiving the reinforcement flange.

The socket element is preferably a gear having equally spaced teeth formed on its outer perimeter. The threaded bore formed in the socket element preferably opens into the outer perimeter of the socket element in a land formed between two teeth of the socket element.

As readily appreciated by one skilled in the art, the present invention provides an adjustable crankshaft rotating ratchet wrench which can quickly and easily be adapted to fit different sizes of keyed shafts. By providing an adjustable wrench for keyed shafts one wrench can be used to cover a variety of shaft sizes and time can be saved when performing a repair. The adjustment mechanism provided by each of the illustrated embodiments is simple but effective and rugged enough to withstand normal torque loads. Through the adjustability of the wrench, a good fit to the keyed shaft is assured and any possibility of damage to the shaft is minimized.

The disclosed adjustment mechanisms do not substantially increase the width of the wrench and in two embodiments it is not necessary to add to the width of the wrench at all. This is an important factor when the shaft length to be engaged by the wrench is limited.

These and other objects and advantages will become apparent upon review of the attached drawings in light of the following detailed description.

DETAILED DESCRIPTION

Figure 1:
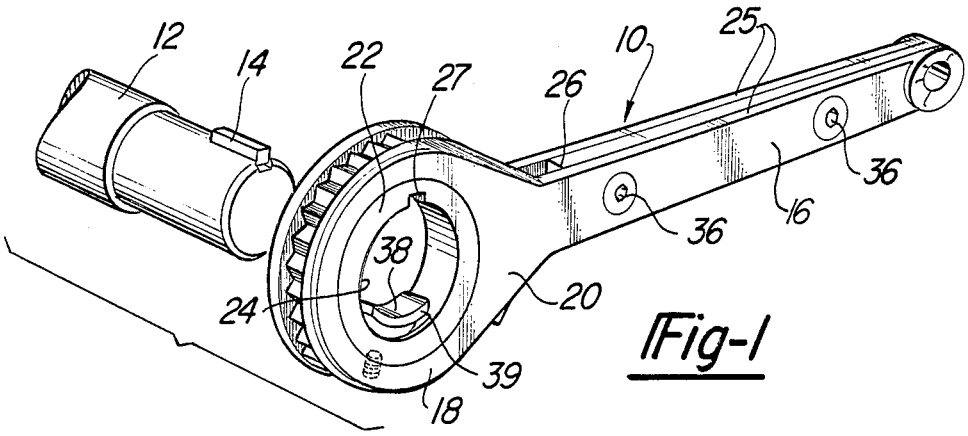
FIG. 1 is a perspective view showing a ratchet wrench for turning a keyed shaft according to the present invention located adjacent to one end of a keyed shaft.

Referring now to FIGS. 1–4, one embodiment of the present invention will be described in detail. In FIG. 1, an adjustable ratchet wrench 10 for turning shafts 12 having a key 14 is shown. The ratchet wrench 10 includes a handle portion 16 having a head 18 at one end 20. The head 18 is preferably formed as an integral part of the handle 16. A socket element 22 is captured between two plates 25 which are secured together to form opposite sides of the handle 16 and head 18. A spacer 26 is retained between the plates 25 and forms part of the handle 16.

The socket element 22 has an inner diameter 24. The inner diameter 24 is a cylindrical surface extending perpendicularly to the length of the handle 16 along an axis X. A key receiving slot 27 is formed in the inner diameter 24 of the socket element 22. The key receiving slot 27 extends in the same direction as the axis X axially along the cylindrical surface of the inner diameter 24. The key receiving slot 27 receives and retains the key 14 when the socket element 22 is placed over the shaft 12.

A ratchet means 28 operatively interconnects the head and socket element for the purpose of selectively locking the socket element against rotation about the axis in one direction while permitting rotation in an opposite direction. The ratchet means 28 includes a plurality of radially outwardly extending teeth 29 formed on the socket element 22. A root portion 30 is formed between each of the teeth 29. Teeth 29 are engaged by a switchable locking cam 31. The locking cam 31 is switchable between the position shown in solid lines and the position shown in phantom lines in FIG. 2. The locking cam 31 has a clockwise locking surface 32 on one end and a counterclockwise locking surface 33 on the opposite end. The locking surfaces 32 and 33 prevent rotation of the socket element 22 in one direction depending upon the position in which the locking cam 31 is placed. The locking cam 31 is held in position by a spring biased pin 34. The spring biased pin 34 is retained in a bore 35 formed in a wrench body spacer 26. The plates 25 and wrench body spacer 26 are held together by fasteners 36 such as rivets or bolts. The locking cam 31 is switchable between its clockwise and counterclockwise locking positions.

The adjustment mechanism of the wrench of the present invention comprises crescent block 38. In the embodiment illustrated in FIGS. 1–4 the crescent block 38 forms jaw 39 which is positionable within the inner diameter 24 of the socket element 22. The jaw 39 includes an arcuate face 40 which is a cylindrical segment having substantially the same radius as the inner diameter 24. The jaw 39 also includes an outer surface 41. The socket element 22 preferably includes a circumferentially extending slot 42 formed intermediate the inner diameter 24 for receiving the jaw 39.

An arcuate rib 43 may extend radially outwardly from the outer surface 41 which is received in the corresponding arcuate radially extending groove 44 which is formed in circumferential slot 42. The jaw 39 may further include an adjustment screw 45 for moving the jaw 39 radially relative to the inner diameter 24.

Figure 4:
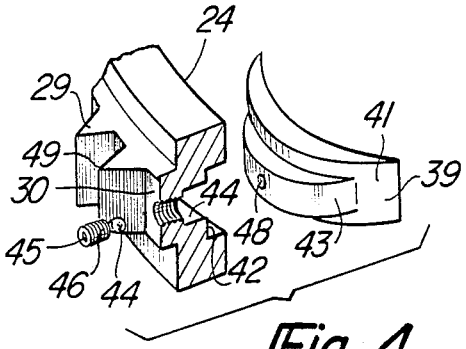
FIG. 4 is an exploded perspective view of a socket element, a jaw and an adjustment screw.
Figure 3:
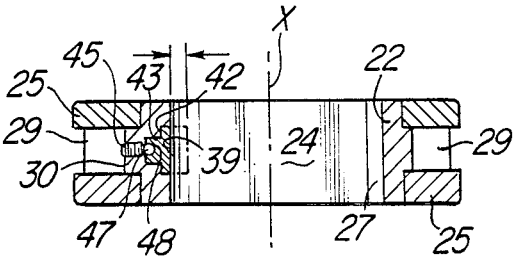
FIG. 3 is a cross-sectional view taken along the line 3—3 in FIG. 2.

Referring now to FIGS. 3 and 4, the adjustment screw 45 includes a threaded shaft 46 and a ball 47 at one end. The ball 47 is received in a partially spherical bore 48 formed in the arcuate rib 43. The partially spherical bore 48 is assembled to the ball 47 by swaging the opening to the partially spherical bore 48 thereby capturing the ball 47 rotatably within the bore 48. The adjustment screw 45 includes a conventional allen head or screw driver slot in the end of the threaded shaft 46 opposite the ball 47. The adjustment screw 45 is received in a threaded bore 49 formed through the socket element. The threaded bore 49 extends radially from the inner diameter of the socket element to the root 30 formed between two adjacent teeth 29. By locating &:he threaded bore in the root 30 interference with the operation of the locking cam 31 is avoided. The location of the adjustment screw 45 is advantageous in that it does not add to the width of the ratchet wrench. Also, the adjustment screw 45 is accessible while the wrench is engaging the shaft 12 to change the pressure exerted by the jaw 39 on the shaft 12.

The jaw 39 is preferably located diametrically opposite the key receiving slot 27 in the embodiment of FIGS. 1–4. In this way, jaw 39 holds key 14 within the key receiving slot 27 assuring proper engagement of the wrench 10 on the shaft 12 and key 14.

Figure 2:
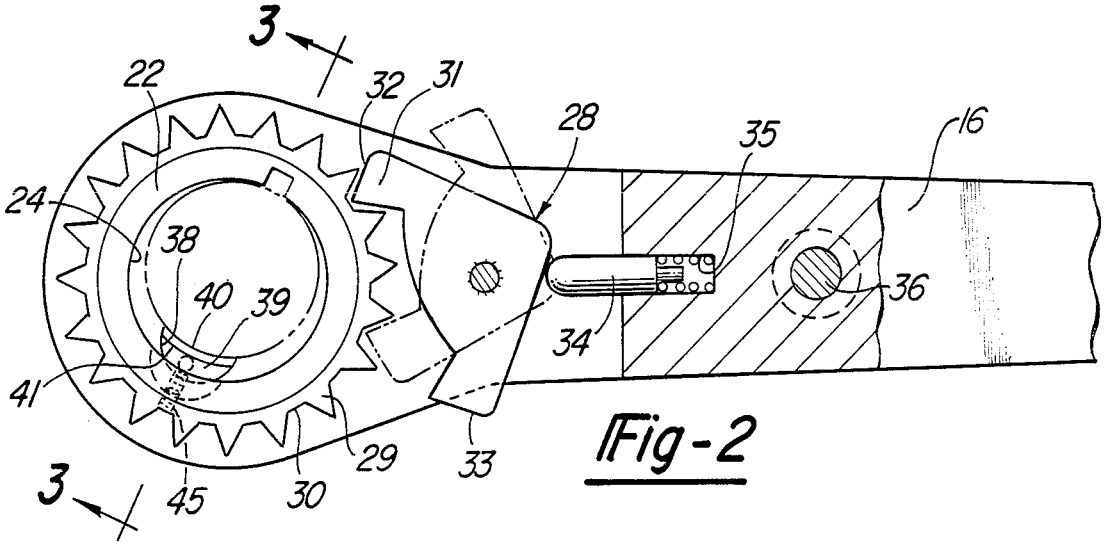
FIG. 2 is a fragmentary plan view of the wrench shown in FIG. 1 with one side of the wrench broken away to illustrate the ratchet mechanism and jaw adjustment means.

As shown in FIG. 2 and 3, the jaw 39 is shiftable radially between the position shown in solid lines and the position shown in phantom lines. Shifting the jaw 39 changes the effective inner diameter 24 of the socket element 22 to permit different size shafts to be engaged by the wrench. Adjustment of the jaw 39 is quickly and efficiently accomplished by merely turning the adjustment screw 45.

Figure 5:
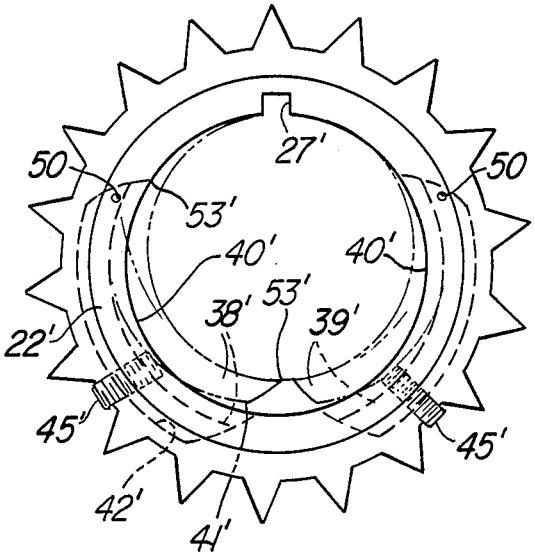
FIG. 5 is a plan view of an alternative socket element having two adjustable jaws pivotally mounted on the socket element.

An alternative embodiment of the socket element is shown in FIG. 5. As appropriate, the same reference numerals having a single prime ′ will be used to introduce similar elements to those previously described with regard to the embodiment of FIGS. 1 through 4. It will be understood that the wrench and ratchet means described above can be used with the socket element shown in FIG. 5.

In FIG. 5, two crescent blocks 38′, or jaws 39′, are provided. The jaws 39′ are each pivotably secured to pivot pins 50. Pivot pins 50 are equally spaced from the key receiving slot 27′. Jaws 39′ extend from the pivot pins 50 away from the key receiving slot 27'. Each of said crescent blocks is connected to a adjustment screw 45' which is preferably connected as previously described. The adjustment screw is spaced from the pivot pin 50.

Figure 6:
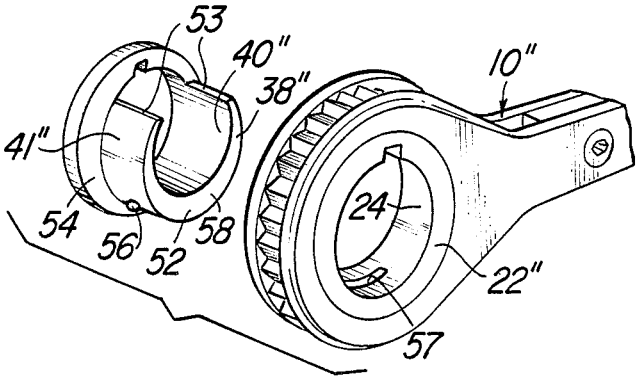
FIG. 6 is a partial perspective view of a keyed shaft, a ratchet wrench and a bushing made in accordance with the present invention.

Referring now to FIG. 6, another alternative embodiment is shown designation used to refer to elements previously described. In the embodiment of FIG. 6, a bushing 52 is provided for a ratchet wrench 10'' having a socket element 22'' for engaging a keyed shaft 12''. The bushing 52 is completely separable from the socket element 22'' but may be inserted within the socket element to adapt it for a smaller diameter shaft. The bushing 52 includes a crescent block 38'' which is inserted into the socket element 22. The crescent block 38'' includes an arcuate face 40'' and an outer surface 41'' comprising cylindrical surfaces that are eccentric to one another. The eccentric surfaces (40'', 41'') intersect at spaced ends 53. The inner cylindrical surface 40'' is eccentric relative to the outer surface 41'' in the direction of the key receiving slot.

On one axial end of the crescent block 38'' an annular ring 54 is provided. The annular ring 54 is abutted against the side of the socket element 22'' when the bushing 52 is installed therein. The bushing 52 is retained within the socket element by a ball detent 56 which engages a bore or slot 57 formed in the inner diameter 24'' of the socket element 22''. The slot 57 is formed intermediate the axial width of the socket element 22''.

Figure 7:
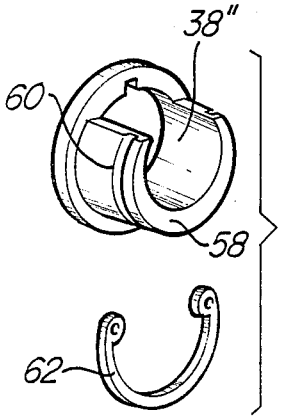

Alternatively, as shown in FIG. 7, the crescent block 38'' may be slightly greater in width than the insert element 22''. In the alternative embodiment the end 58 of the crescent block 38'' opposite the annular ring extends slightly outside the socket element 22''. The end of the crescent block 38'' extending outside the socket element 22'' would include a groove (60) for receiving a snap ring (not shown) that would effectively hold the bushing in the socket element 22''. It would be readily appreciated by one skilled in the art that retention means other than the ball detent 56 or snap ring 62 could be used to hold the bushing 52 within the socket element 22''.

The foregoing is a description of several embodiments of the present invention and should not be read in a restrictive sense but only to explain the underlying concepts. Invention may be further developed within the scope of the following claims.

What is claimed is:

1. A ratchet wrench (10) for turning a shaft (12) having a key (14), comprising:

an elongated handle (16);

a head (18) connected to one end (20) of the handle;

a socket element (22) disposed within said head and having a substantially cylindrical inner diameter (24) extending along an axis (X) perpendicular to the handle, said socket element having a key receiving slot (27) extending outwardly from the inner diameter and in the same direction as said axis, said socket element further having an arcuate slot (42) therein;

ratchet means (28) operatively associated with said head and said socket element for selectively locking the socket element against rotation about the axis in one direction while permitting rotation in an opposite direction;

a crescent block (38) having an arcuate face (40) and an outer surface (41) shaped to be received by the arcuate slot (42) of the socket element, said arcuate face being eccentric relative to the outer surface and intersecting the outer surface (41) at two spaced ends of the crescent block, said crescent block being received within the inner diameter of the socket element diametrically opposite the key receiving slot with the ends being substantially equidistant from the key receiving slot, said crescent block being adjustable within the inner diameter of the socket element to receive and retain a shaft within the inner diameter of the socket element; and an adjustment screw (45) connected to the socket element and said crescent block to adjust said crescent block within the socket element.

2. The ratchet wrench of claim 1 wherein said socket element has radially outwardly extending spaced teeth (49) defining root portions (30) between adjacent teeth, said fastener (45) extending from the inner diameter (24) to one of the root portions to facilitate adjusting the position of the crescent block (38) inside the socket element (22) from within the confines of the head (18).

3. A ratchet wrench (10) for turning a shaft (12) having a key (14), comprising:

an elongated handle (16);

a head (18) connected to one end (20) of the handle;

a socket element (22) disposed within said head and having a substantially cylindrical inner diameter (24) extending along an axis (X) perpendicular to the handle, said socket element having a key receiving slot (27) extending outwardly from the inner diameter and in the same direction as said axis, said socket element further defining an arcuate slot (42);

ratchet means (28) operatively associated with said head and said socket element for selectively locking the socket element against rotation about the axis in one direction while permitting rotation in an opposite direction;

two crescent blocks (38', 39') each having an arcuate face (40') and an outer surface (41') shaped to be received by the arcuate slot (42') of the socket element, said arcuate face being eccentric relative to the outer surface and intersecting the outer surface (41') at two spaced ends (53') of the crescent blocks, said crescent blocks being received within the inner diameter of the socket element and each being pivotally secured adjacent one end thereof to the socket element (22) at equally spaced distances from the key receiving slot (27); and two adjustment screws (45'), each of said adjustment screws being connected to the socket element and one of said crescent blocks to adjust said crescent blocks within the socket element.

4. A ratchet wrench (10) for turning a shaft (12) having a key (14), comprising:

an elongated handle (16);

a head (18) connected to one end (20) of the handle;

a socket element (22) disposed within said head and having a substantially cylindrical inner diameter (24) axially extending along an axis (X) perpendicular to the handle, said socket element having a key receiving slot (27) extending outwardly from the inner diameter and in the same direction as said axis;

ratchet means (28) operatively associated with said head and said socket element for selectively locking the socket element against rotation about the axis in one direction while permitting rotation in an opposite direction;

at least one jaw means (39) having an arcuate face (40), said jaw means being received in a slot (42) extending arcuately about the axis and being formed internally within the inner diameter (24) of the socket element and centered diametrically opposite the key receiving slot (27) for changing the effective inner diameter of the socket element; and an adjustment screw (45) connected to said jaw means and said socket element, said adjustment screw having a threaded shaft (46) which is received in a threaded bore (49) extending through the socket element radially outwardly from the arcuately extending slot.

5. The ratchet wrench of claim 4 wherein said jaw means (39) further includes an arcuate rib (43) extending radially outwardly from an outer surface (41) of the jaw means, said inner surface (24) having an arcuate radially extending groove (44) below the slot (42) which receives the arcuate rib when the jaw means is retracted into the socket element.

6. A ratchet wrench (10) for turning a shaft (12) having a key (14), comprising:

an elongated handle (16);

a head (18) connected to one end (20) of the handle;

a socket element (22) disposed within said head and having a substantially cylindrical inner diameter (24) extending along an axis (X) perpendicular to the handle, said socket element having a key receiving slot (27) extending outwardly from the inner diameter and in the same direction as said axis;

ratchet means (28) operatively associated with said head and said socket element for selectively locking the socket element against rotation about the axis in one direction while permitting rotation in an opposite direction;

a bushing (52) having an outer surface (41) shaped to be fitted against the inner diameter (24) of the socket element and an inner cylindrical surface (40) eccentric to the outer surface for changing the effective inner diameter of the socket element when inserted therein; and retention means (56) for locking said bushing in said socket element.

7. The ratchet wrench of claim 6 wherein the bushing includes an annular ring (54) on one axial end thereof which is adapted to be abutted against one axial end of the socket element, and said retention means is a ball detent (56) is provided in the outer surface (41) of the socket element which is received in a slot (57) formed in the inner diameter of the socket element.

8. The ratchet wrench of claim 6 wherein the bushing (52) includes an annular ring (54) on one axial end thereof which is adapted to be abutted against one axial end of the socket element (22), the busing having a snap ring retaining groove on the axially opposite end of the bushing from the annular ring; and a snap ring adapted to be placed in the snap ring retaining groove to retain the bushing on the socket element.

9. A ratchet wrench (10) for turning a shaft (12) having a key (14), said wrench having an elongated handle (16), a head (18) connected to one end (20) of the handle, a socket element (22) disposed within said head and having a substantially cylindrical inner diameter (24) extending along an axis (X) perpendicular to the handle, said socket element having a key receiving slot (27) extending outwardly from the inner diameter and in the same direction as said axis, ratchet means (28) operatively associated with said head and said socket element for selectively locking the socket element against rotation about the axis in one direction while permitting rotation in an opposite direction, wherein the improvement comprises:

jaw means (39) for receiving and retaining the shaft within the inner diameter of the socket element, said jaw means having a cylindrical arcuate face (40) and having an adjustment screw (45) being connected to the socket element and the jaw means, said jaw means having adjustment means for adjusting the position of the jaw means to shift the shaft to a position eccentric to the axis (X) in the direction of the key of the shaft within the socket element to allow a shaft of smaller diameter to be received by the socket so that torque applied by the wrench is applied against the key retained by the shaft.

10. The ratchet wrench of claim 9 wherein said socket element is a gear having radially outwardly extending spaced teeth (29) defining root portions (30) between adjacent teeth, said adjustment screw (45) extending from the inner diameter to one of the root portions to facilitate adjusting the position of the jaw means inside the socket element from within the confines of the head (18).

11. In combination, a bushing kit, a socket wrench having a socket, and a shaft having a key disposed at a point on the circumference of the shaft, said shaft having a central axis, the combination comprising:

a bushing (52) having an outer cylindrical surface (41) and an inner cylindrical surface (40) eccentric to the outer surface for changing the effective inner diameter of the socket, said bushing being axially inserted into said socket, said bushing having retention means (56, 57) for locking said bushing axially within said socket, said socket having a key receiving slot a circumferential location which is aligned with the key on the shaft, said bushing reducing the effective inner diameter of the socket as required to allow a shaft of smaller diameter to be received by the socket so that torque applied by the wrench is applied against the key retained by the shaft.

12. The ratchet wrench of claim 11 wherein the busing includes an annular ring (54) on one axial end thereof which is adapted to be abutted against one axial end of the socket element (22), and said retention means is a ball detent (56) provided in the outer surface of the socket which is received in a slot (57) formed in the inner diameter of the socket.

13. The ratchet wrench of claim 11 wherein the bushing includes an annular ring (54) on one axial end thereof which is adapted to be abutted against one axial end of the socket, and said retention means is a snap ring retaining groove provided on the bushing on the opposite end of the bushing from the annular ring and a snap ring placed in the snap ring retaining groove to retain the bushing on the socket.

* * * * *

UNITED STATES PATENT AND TRADEMARK OFFICE

CERTIFICATE OF CORRECTION

PATENT NO. : 4,873,899

DATED : October 17, 1989

INVENTOR(S) : Tadeusz L. Mazurek

It is certified that error appears in the above-identified patent and that said Letters Patent is hereby corrected as shown below:

| | |
|---|---|
| Column 2, line 42 | "&.he" should be --the--. |
| Column 4, line 37 | "&:he" should be --the--. |
| Column 4, line 58 | After "appropriate," delete --the same--. |
| Column 5, line 3 | After "connected" insert --thereto--. |
| Column 5, line 7 | After "shown" insert --with a double prime (')--. |
| Column 5, line 37 | "(60)" should be --60--. |
| Column 5, line 38 | Delete "(not shown)" and insert --62--. |
| Column 8, lines 50,51 | "busing" should be --bushing--. |

Signed and Sealed this

Eighteenth Day of September, 1990

*Attest:*

HARRY F. MANBECK, JR.

*Attesting Officer*

*Commissioner of Patents and Trademarks*